US009815650B2

(12) United States Patent
Yamada

(10) Patent No.: US 9,815,650 B2
(45) Date of Patent: Nov. 14, 2017

(54) SHEET SKEW FEED CORRECTION APPARATUS, IMAGE FORMING APPARATUS AND SKEW FEED CORRECTION APPARATUS

(71) Applicant: CANON KABUSHIKI KAISHA, Tokyo (JP)

(72) Inventor: Koichi Yamada, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/214,813

(22) Filed: Jul. 20, 2016

(65) Prior Publication Data

US 2016/0325956 A1 Nov. 10, 2016

Related U.S. Application Data

(62) Division of application No. 13/558,617, filed on Jul. 26, 2012, now Pat. No. 9,428,356.

(30) Foreign Application Priority Data

Aug. 22, 2011 (JP) ..... 2011-180630

(51) Int. Cl.
*B65H 9/06* (2006.01)
*B41J 13/28* (2006.01)
*B65H 9/00* (2006.01)

(52) U.S. Cl.
CPC ..... *B65H 9/06* (2013.01); *B65H 9/004* (2013.01); *B65H 2301/331* (2013.01);
(Continued)

(58) Field of Classification Search
None
See application file for complete search history.

(56) References Cited

U.S. PATENT DOCUMENTS 4,010,528 A 3/1977 Bohmer
4,346,883 A 8/1982 Speraggi
(Continued)

FOREIGN PATENT DOCUMENTS

CN 101205024 A 6/2008
CN 101412478 A 4/2009
(Continued)

OTHER PUBLICATIONS

Apr. 19, 2016 Office Action issued in corresponding Japanese counterpart application 2012-176676.
Chinese Office Action issued in counterpart Chinese Application No. 201210294717.2, dated Aug. 25, 2014.

*Primary Examiner* — Matthew G Marini
*Assistant Examiner* — Ruben Parco, Jr.
(74) *Attorney, Agent, or Firm* — Fitzpatrick, Cella, Harper & Scinto

(57) ABSTRACT

A sheet skew feed correcting apparatus is provided which includes: a driving rotation member that is driven to rotate; a first driven rotation member that is pressure contacted against the driving rotation member; a first holder rotatably holding the first driven rotation member; a second driven rotation member that is pressure contacted against the driving rotation member; a second holder rotatably holding the second driven rotation member; and a shutter portion with which a leading end of a sheet comes into contact for skew feed correction, the shutter portion moving pivotally with one end portion thereof supported by the first holder and another end portion thereof supported by the second holder; wherein the shutter portion has abutting portions with which the leading end comes into contact, and a coupling portion extending so as to couple the abutting portions together between the first and the second driven rotation members.

12 Claims, 10 Drawing Sheets

(52) U.S. Cl.
CPC .. *B65H 2404/143* (2013.01); *B65H 2404/722* (2013.01); *B65H 2801/06* (2013.01)

(56) References Cited

U.S. PATENT DOCUMENTS

| | | | | |
|---|---|---|---|---|
| 4,844,443 | A | 7/1989 | Trafton | |
| 6,011,948 | A | 1/2000 | Amano et al. | |
| 8,342,519 | B2 | 1/2013 | Watanabe et al. | |
| 2001/0033760 | A1 | 10/2001 | Sawanaka et al. | |
| 2005/0200681 | A1 | 9/2005 | Nakayama | |
| 2008/0310906 | A1 | 12/2008 | Yang | |
| 2009/0102117 | A1 | 4/2009 | Yu et al. | |
| 2010/0301546 | A1 | 12/2010 | Ninomiya | |
| 2011/0089628 | A1* | 4/2011 | Watanabe ..... | B65H 9/004 271/110 |

FOREIGN PATENT DOCUMENTS

| | | | |
|---|---|---|---|
| EP | 0782967 | A1 | 7/1997 |
| JP | 63-110433 | U | 7/1988 |
| JP | 09-183539 | A | 7/1997 |
| JP | 11255378 | A | 9/1999 |
| JP | 2001-139179 | A | 5/2001 |
| JP | 2002265100 | A | 9/2002 |
| JP | 2006096433 | A | 4/2006 |
| JP | 2006312543 | A | 11/2006 |
| JP | 2010-235259 | A | 10/2010 |
| JP | 2010-079608 | A | 4/2011 |
| WO | 2011048668 | A1 | 4/2011 |

* cited by examiner

SHEET SKEW FEED CORRECTION APPARATUS, IMAGE FORMING APPARATUS AND SKEW FEED CORRECTION APPARATUS

BACKGROUND OF THE INVENTION

Field of the Invention

The present invention relates to a sheet conveying apparatus and an image forming apparatus, and in particular, to a configuration of a skew feed correcting portion that corrects possible skew feed of a sheet.

Description of Related Art

Image forming apparatuses such as copiers, printers and facsimile machines conventionally include an image forming portion and a sheet conveying apparatus that uses conveying rollers to convey a sheet to the image forming portion. In the conventional image forming apparatus, a sheet may be fed obliquely when conveyed because the conveying rollers are deformed or misaligned. In the image forming apparatus, the accuracy of an image forming position with respect to the sheet depends significantly on the position of the sheet with respect to the image forming portion. Thus, accurately aligning the sheet with the image forming portion is an important factor for image quality.

In the conventional image forming apparatus, the sheet conveying apparatus includes a skew feed correcting portion to correct possible skew feed of a sheet, thus improving the accuracy of the image formation position. An example of such a skew feed correcting portion includes a shutter biased by a spring in a direction opposite to a sheet conveying direction and with which a leading end of the sheet is brought into abutting contact (see Japanese Patent Application Laid-Open No. H09-183539 and Japanese Patent Application Laid-Open No. 2010-235259 and Japanese Patent Application Laid-Open No. 2011-079608).

FIG. 13 is a perspective view showing a configuration of a conventional skew feed correcting portion. As illustrated in FIG. 13, a sheet P conveyed by a conveying unit (not illustrated in the drawings) is transferred to a nip formed by a driving roller 91 (91*a* and 91*b*) and a driven roller 92 (92*a* and 92*b*). The driven roller 92 is rotatably supported by a driven roller shaft 94. A shutter member 95 is pivotally movably mounted on the driven roller shaft 94.

The shutter member 95 includes abutting portions 95*a* and 95*b* at the opposite ends thereof in a width direction orthogonal to the sheet conveying direction. The abutting portions 95*a* and 95*b* come into abutting contact with the conveyed sheet P. The abutting portions 95*a* and 95*b* are positioned upstream, in the conveying direction, of the nip formed by the driving roller 91 and the driven roller 92. The shutter member 95 is biased by its own weight or a spring member in the direction opposite to the sheet conveying direction.

The leading end of the sheet is come into abutting contact with the abutting portions 95*a* and 95*b* of the shutter member 95. The sheet P is looped with the leading end of the sheet P coming into abutting contact with the shutter member 95 so as to follow the shutter member 95.

When the sheet P follows the shutter member 95 while being looped, the skew feed of the sheet P is corrected. When the leading end of the sheet P follows the shutter member 95, the stiffness of the looped sheet P subsequently allows the sheet P to pass through the shutter member 95 while pivotally moving the shutter member 95, against the spring, which acts to bias the shutter member 95. After the trailing end of the sheet P passes through the shutter, the shutter member 95 is returned, by the bias force of the spring, from a position where the shutter member 95 is retracted from a conveying path back to a home position. The shutter member 95 comes into abutting contact with a stopper and is held at the home position.

In the conventional sheet conveying apparatus including the skew feed correcting portion and the image forming apparatus including the sheet conveying apparatus, the shutter member 95 requires a given time to return from the position where the shutter member 95 is retracted from the conveying path to the home position. Moreover, upon returning to the home position, the shutter member 95 collides against the stopper and bounds several times due to this shock.

In particular, as illustrated in FIG. 13, if the shutter member 95 is pivotally movably mounted on the driven roller shaft 94 so as to partly cover the driven roller 92, the distance between the shutter member 95 and the driven roller shaft 94 is longer than the diameter of the driven roller 92. In this case, the shutter member 95 has an increased moment of inertia, which increases the number of bounds, requiring more time to completely return to the home position.

When a longer time is required for the shutter member to completely return to the home position, the sheet may be conveyed to the skew feed correcting portion before the shutter member completely returns to the home position. In this case, the skew feed of the sheet cannot be reliably corrected, and the capability of correcting the skew feed varies. When, for example, a long distance is set between one sheet and the succeeding sheet in order to prevent the variation in the capability of correcting the skew feed, the productivity of the image forming apparatus is hindered from being improved.

In view of the above-described circumstances, an object of the present invention is to provide a sheet conveying apparatus and an image forming apparatus which enable a reduction in the return time and bound time of the shutter.

SUMMARY OF THE INVENTION

According to an exemplary embodiment of the present invention, a sheet skew feed correcting apparatus is provided which includes: a driving rotation member that is driven to rotate; a first driven rotation member that is pressure contacted against the driving rotation member so that the first driven rotation member and the driving rotation member nip and covey a sheet; a first holder that rotatably holds the first driven rotation member; a second driven rotation member which is pressure contacted against the driving rotation member so that the second driven rotation member and the driving rotation member nip and covey the sheet, wherein the first driven rotation member and the second driven rotation member are arranged along a width direction of the sheet orthogonal to a conveying direction; a second holder that rotatably holds the second driven rotation member; and a shutter portion that pivotally moves to a position through which the sheet is allowed to pass after a leading end of the conveyed sheet comes into contact with the shutter portion for a skew feed correction of the sheet, the shutter portion moving pivotally with one end portion thereof supported by the first holder and another end portion thereof supported by the second holder in the width direction of the sheet, wherein the shutter portion has a plurality of abutting portions with which the leading end of the sheet comes into contact, the abutting portions arranged at intervals in the width direction, and a coupling portion extending in the width direction to couple the plurality of abutting portions together between the first driven rotation member and the second driven rotation member in the width direction, the coupling portion arranged closer to a center of rotation of each of the first and second driven rotation members than to an outer peripheral surface of each of the first and second driven rotation members in a radial direction of the first and second driven rotation members.

Further, according to an exemplary embodiment of the present invention, an image forming apparatus is provided which includes: a driving rotation member that is driven to rotate; a first driven rotation member that is pressure contacted against the driving rotation member so that the first driven rotation member and the driving rotation member nip and covey a sheet; a first holder that rotatably holds the first driven rotation member; a second driven rotation member which is pressure contacted against the driving rotation member so that the second driven rotation member and the driving rotation member nip and covey the sheet, wherein the first driven rotation member and the second driven rotation member are arranged along a width direction of the sheet orthogonal to a conveying direction; a second holder that rotatably holds the second driven rotation member; a shutter portion that pivotally moves to a position through which the sheet is allowed to pass after a leading end of the conveyed sheet comes into contact with the shutter portion for a skew feed correction of the sheet, the shutter portion moving pivotally with one end thereof supported by the first holder and another end thereof supported by the second holder in the width direction of the sheet; and an image forming portion that forms an image on the sheet subjected to skew feed correction by the shutter portion, wherein the shutter portion has a plurality of abutting portions with which the leading end of the sheet comes into contact, the abutting portions arranged at intervals in the width direction, and a coupling portion extending in the width direction to couple the plurality of abutting portions together between the first driven rotation member and the second driven rotation member in the width direction, the coupling portion arranged closer to a center of rotation of each of the first and second driven rotation members than to an outer peripheral surface of each of the first and second driven rotation members in a radial direction of the first and second driven rotation members.

Further, according to an exemplary embodiment of the present invention, a skew feed correcting apparatus correcting skew feed of a sheet is provided which includes: a driving rotation member that is driven to rotate; a first driven rotation member that is pressure contacted against the driving rotation member so that the first driven rotation member and the driving rotation member nip and covey the sheet; a first holder that rotatably holds the first driven rotation member; a second driven rotation member which is pressure contacted against the driving rotation member so that the second driven rotation member and the driving rotation member nip and covey the sheet, wherein the first driven rotation member and the second driven rotation member are arranged along a width direction of the sheet orthogonal to a conveying direction; a second holder that rotatably holds the second driven rotation member independently of the first driven rotation member; a shutter portion that has a plurality of abutting portions, arranged at intervals in the width direction of the sheet, with which a leading end of the sheet comes into contact and pivotally moves to a position through which the sheet is allowed to pass after the leading end of the conveyed sheet comes into contact with the plurality of abutting portions; a first support portion provided in the first holder and pivotally movably supporting the shutter portion; and a second support portion provided in the second holder and pivotally movably supporting the shutter portion.

The present invention can reduce the moment of inertia of the shutter member, and thus the return time and bound time of the shutter member can be reduced.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

Figure 1:
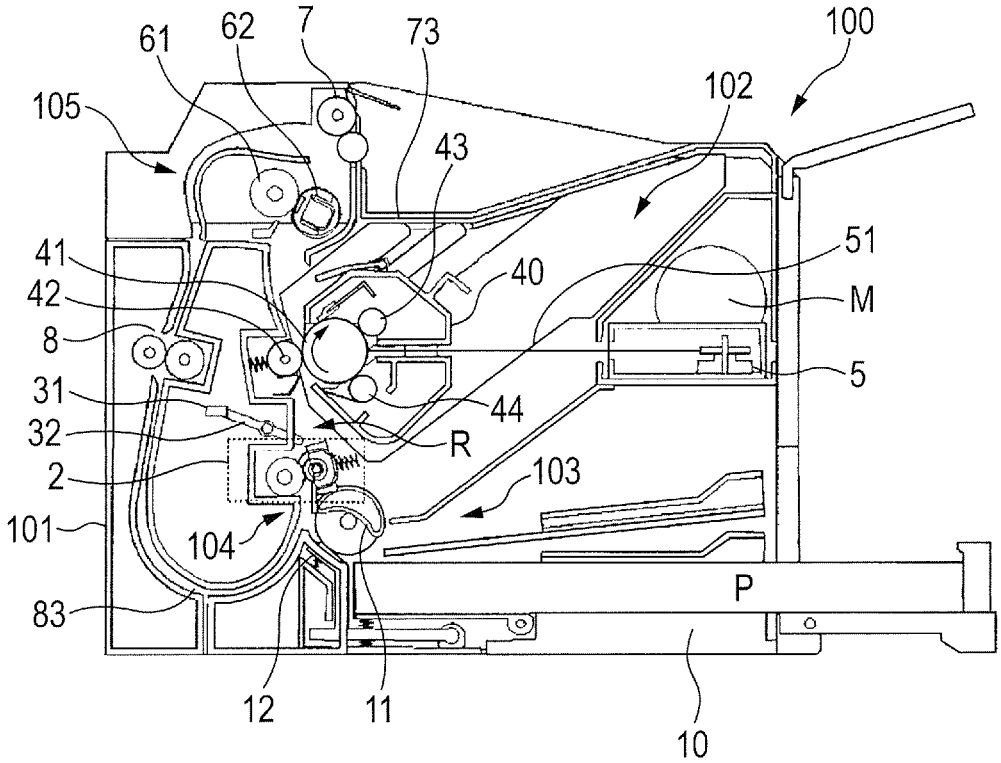
FIG. 1 illustrates a general configuration of a laser printer that is an example of an image forming apparatus with a sheet conveying apparatus according to a first exemplary embodiment of the present invention.

Exemplary embodiments of the present invention will be described below with reference to the drawings. FIG. 1 illustrates a general configuration of a laser printer that is an example of an image forming apparatus with a sheet conveying apparatus according to a first exemplary embodiment of the present invention.

In FIG. 1, a laser beam printer 100 includes a laser beam printer main body (hereinafter referred to as a printer main body) 101 that is an image forming apparatus main body. The laser beam printer 100 includes an image forming portion 102, a sheet feeding portion 103 that feeds a sheet P, and a sheet conveying apparatus 104 that conveys the sheet P fed out by the sheet feeding portion 103 to the image forming portion 102. Furthermore, the laser beam printer 100 includes a re-conveying portion 105 that conveys the sheet P with an image formed on one side thereof again to the image forming portion 102.

The image forming portion 102 includes a removable process carriage 40 with integrated process unit including a photosensitive drum 41 that is an image bearing member, a developing roller 44, and a charging roller 43. Furthermore, the image forming portion 102 includes a laser scanner 5 that exposes a surface of the photosensitive drum 41 to form an electrostatic image on the photosensitive drum.

The sheet feeding portion 103 includes a sheet feeding tray 10 with sheets P stacked thereon and a sheet feeding roller 11 that feeds the sheets P on the sheet feeding tray one by one. The sheet conveying apparatus 104 includes a skew feed correcting portion 2 that subjects the sheet to skew feed correction. The re-conveying portion 105 includes a duplex conveying roller pair 8 which reverses the sheet P with the image formed thereon and which then conveys the sheet P to the image forming portion 102 again.

In FIG. 1, a sheet discharging reverse roller pair 7 can rotate both forward and backward, and if an image is formed on both sides of the sheet, the sheet discharging reverse roller pair 7 is rotated backward to covey the sheet P to the re-conveying portion 105. A separation pad 12 is pressure contacted against the sheet feeding roller 11 by a spring (not illustrated in the drawings). The separation pad 12 separates one sheet from the sheets fed out by the sheet feeding roller 11.

Now, an operation of forming an image by the laser beam printer 100 will be described. When an image forming operation is started, one of the sheets P stacked and stored in the sheet feeding tray 10 is separated and fed out by the separation pad 12 and the sheet feeding roller 11 rotated by operation of a driving motor M. Thereafter, the sheet P is conveyed to the skew feed correcting portion 2, which then subjects the sheet to skew feed correction. The sheet P is then conveyed to a transfer portion including the photosensitive drum 41 and a transfer roller 42.

A sheet detecting flag 32 is provided in a conveying path R from the skew feed correcting portion 2 to the transfer portion in a projecting manner so as to be able to project into and retract from the conveying path R. A leading end of the sheet P is detected when the sheet detecting flag 32 moves from a posture in which the sheet detecting flag 32 blocks the optical axis of a photo interrupter 31 to a posture in which the sheet detecting flag 32 is prevented from blocking the optical axis of the photo interrupter 31 by pushing up the sheet detecting flag 32 by the sheet P subjected to skew feed correction and having passed the skew feed correcting portion 2.

Then, a predetermined time after the detection of the leading end, based on image information, a laser light emitting portion of the laser scanner 5 emits laser light to the photosensitive drum 41 having rotated in the direction of an illustrated arrow and having the surface thereof uniformly charged to a predetermined polarity and a predetermined potential by the charging roller 43. By irradiating the photosensitive drum 41 with the laser light, an electrostatic image is formed on the photosensitive drum 41. Then, the electrostatic image is developed by the developing roller 44 and visualized into a toner image. The toner image formed on the photosensitive drum is transferred to a predetermined position on the sheet P by the transfer roller 42 in the transfer portion.

Then, the sheet P with the toner image transferred thereto is conveyed to a fixing nip formed by a pressure roller 61 and a heating unit 62. The unfixed image is then heated and fixed. Thereafter, the sheet P with the image fixed thereto is conveyed to the sheet discharging reverse roller pair 7, and if simplex printing is specified as a print job, the sheet discharging reverse roller pair 7 discharges the sheet into a sheet discharging tray 73 provided in an upper portion of the printer main body.

On the other hand, if automatic duplex printing is specified as a print job, the sheet P is conveyed for a predetermined time by the sheet discharging reverse roller pair 7. Then, the sheet discharging reverse roller pair 7 is rotated backward by a driving switching mechanism (not illustrated in the drawings), and thus the sheet P is reversed and conveyed to the re-conveying portion 105. Thereafter, the sheet P is guided by a re-conveying path 83 and conveyed to the skew feed correcting portion 2 by the duplex conveying roller pair 8 disposed in a duplex conveying path. The sheet P is subjected to skew feed correction by the skew feed correcting portion 2 and then conveyed to the transfer portion, which then transfers an unfixed image to the sheet as is the case with the first side. Thereafter, the sheet P is conveyed to the fixation nip, where the unfixed image is heated and fixed. The sheet P is then discharged into the sheet discharging tray 73 via the sheet discharging reverse roller pair 7.

Figure 2:
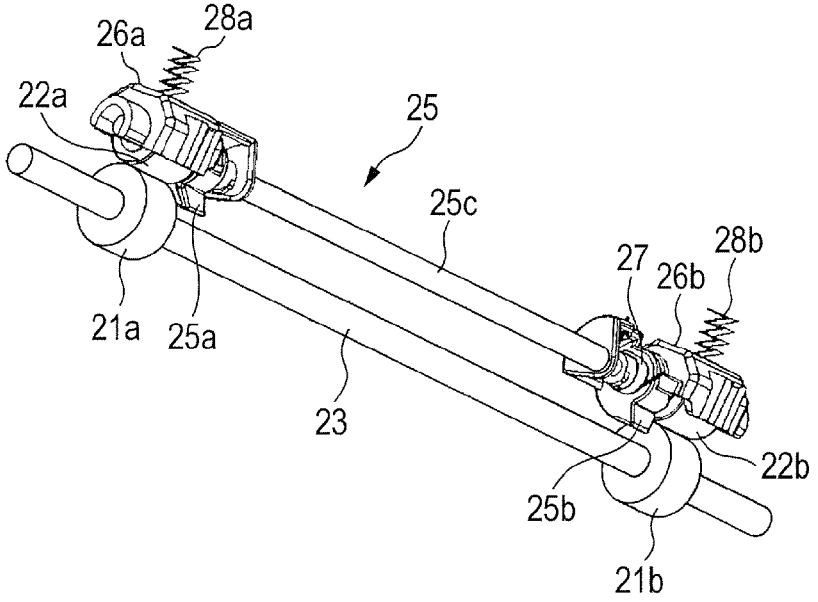
FIG. 2 is a perspective view illustrating a configuration of a skew feed correcting portion provided in the sheet conveying apparatus.
Figure 3:
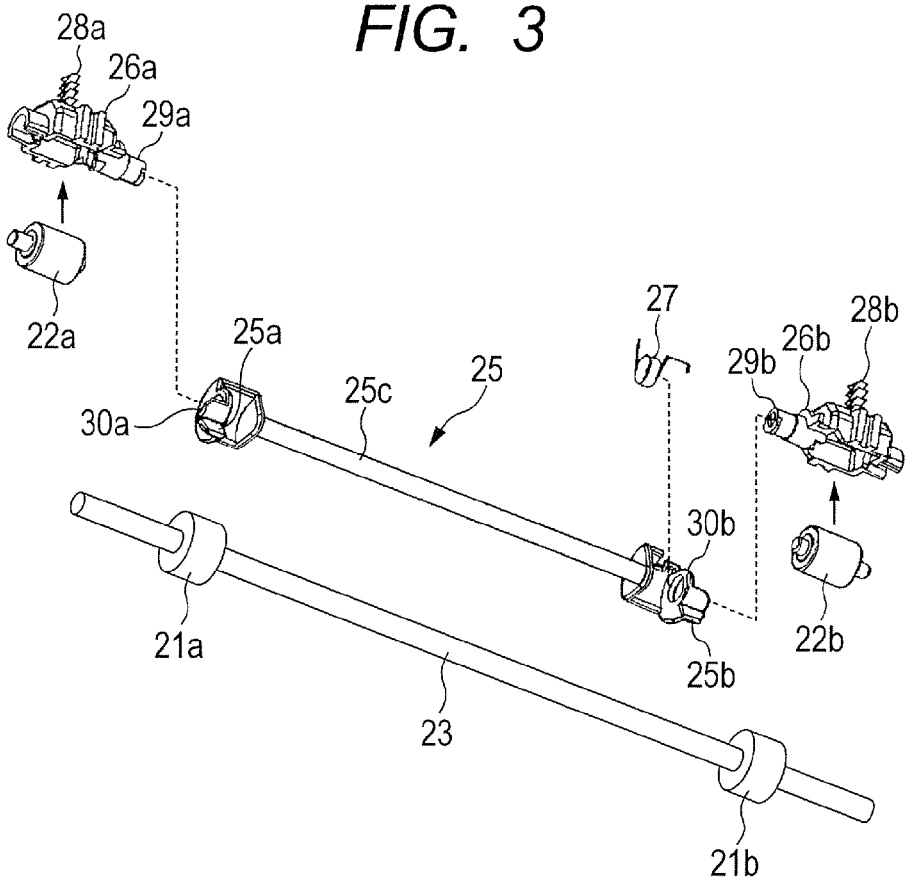
FIG. 3 is an exploded view of the skew feed correcting portion.

Now, a configuration of the skew feed correcting portion 2 according to the present exemplary embodiment will be described with reference to a perspective view illustrated in FIG. 2 and an exploded view illustrated in FIG. 3. In FIG. 2 and FIG. 3, a shutter member 25 serving as a shutter portion includes abutting portions 25*a* and 25*b* which are arranged at the opposite ends thereof in a width direction orthogonal to a sheet conveying direction and which come into abutting contact with the sheet, and a coupling portion 25*c* that couples the abutting portions 25*a* and 25*b* together. That is, according to the present exemplary embodiment, the shutter member 25 is shaped such that the two abutting portions 25*a* and 25*b* and the coupling portion 25*c* are integrated together.

In FIG. 2 and FIG. 3, a first driven roller 22*a* and a second driven roller 22*b* are each shaped such that a roller main body is integrated with a shaft. The first driven roller 22*a* serving as a first driven rotation member and the second driven roller 22*b* serving as a second driven rotation member have the same configuration and will thus be collectively referred to as the driven roller 22 in the description below unless otherwise specified. A plurality of the driven rollers 22 are arranged at intervals in the width direction orthogonal to the sheet conveying direction. A driving roller 21 (21*a* and 21*b*) forms a rotation member pair together with the driven roller 22. The driven roller 22 serving as a second rotation member is pressure contacted against the driving roller 21 serving as a first rotation member so as to be able to come into contact with and separate from the driving roller 21.

A driving roller shaft of the driving roller 21 is numbered 23. A first bearing member 26 is a first holder that pivotally supports the first driven roller 22*a*, and a second bearing member 26*b* is a second holder that pivotally supports the second driven roller 22*b*. The first bearing member 26*a* and the second bearing member 26*b* have the same configuration and will thus be collectively referred to as the bearing member 26 in the description below unless otherwise specified. The bearing members 26*a* and 26*b* include circular bosses 29*a* and 29*b*, respectively, provided on an inner side surface thereof in a projecting manner and serving as a support portion that supports the shutter member 25. The two abutting portions 25*a* and 25*b* of the shutter member 25 include insertion holes 30*a* and 30*b* formed therein into which the circular bosses 29*a* and 29*b* of the bearing members 26*a* and 26*b* are inserted.

When the circular bosses 29*a* and 29*b* of the bearing members 26*a* and 26*b* pivotally supporting the two adjacent driven rollers 22*a* and 22*b* are inserted into the insertion holes 30*a* and 30*b*, the shutter member 25 is pivotally supported by the bearing members 26*a* and 26*b*. That is, the shutter member 25 has the center of pivotal movement thereof supported by the bearing members 26*a* and 26*b* between the two adjacent driven rollers 22*a* and 22*b*.

The shutter member 25 having the center of pivotal movement thereof supported by the bearing members 26*a* and 26*b* is normally biased in a direction opposite to the sheet conveying direction by a helical torsion coil spring 27 mounted in the bearing member 26*b*. The shutter member 25 is thus normally located at a home position. The home position of the shutter member 25 is where abutting surfaces (not illustrated in the drawings) provided on the bearing members 26*a* and 26*b* are in abutting contact with abutting surfaces (not illustrated in the drawings) provided on the shutter member 25 due to the bias by the helical torsion coil spring 27. When the shutter member 25 is located at the home position, the abutting portions 25*a* and 25*b* project upstream, in the conveying direction, of the nip formed by the driving roller 21 and the driven roller 22.

Figure 13:
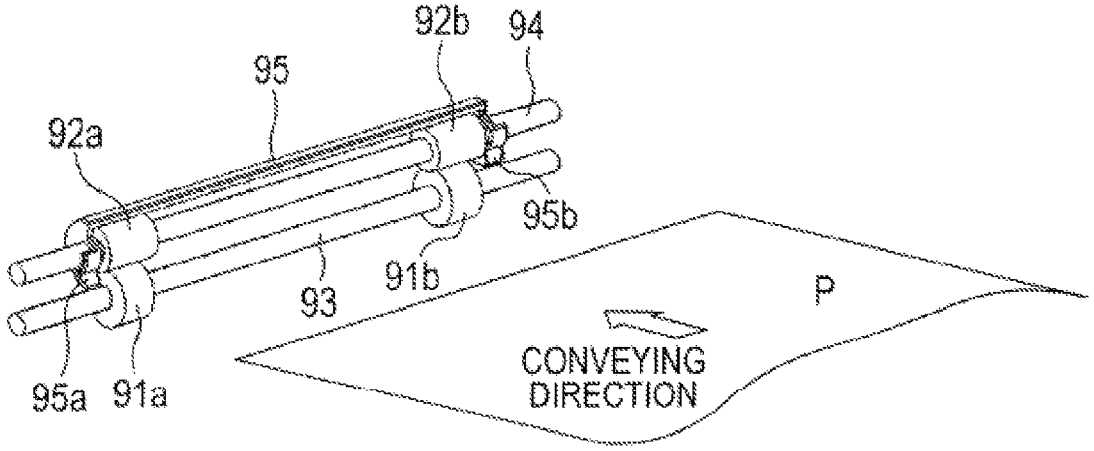
PRIOR ART FIG. 13
FIG. 13 is a perspective view illustrating a configuration of a conventional skew feed correcting portion.

The bearing members 26*a* and 26*b* cause the driven roller 22 to pressure contact against the driving roller 21 by respectively receiving a pressure force from pressurizing springs 28*a* and 28*b*. The bearing members 26*a* and 26*b* are movably held by frames 301*a* and 301*b* (see FIG. 4A) so as to be slidable in a direction parallel to the direction of pressurization by the pressurizing springs 28*a* and 28*b*. Thus, the driven roller 22 can be pressure contacted against the driving roller 21, and when the sheet passes through the nip between the driving roller 21 and the driven roller 22, the driven roller 22 can be moved in the direction of sheet thickness. The conventional technique illustrated in FIG. 13 disadvantageously requires a high cost because one shaft extending in an axial direction supports two driven rollers and thus needs to be strong (for example, the shaft needs to be formed of metal). The present exemplary embodiment provides the two independent driven rollers 22 movably supported by the bearing members 26*a* and 26*b*, respectively. This eliminates the need for a long shaft that supports the plurality of driven rollers 22. Therefore, the skew feed correcting portion according to the present exemplary embodiment requires a lower cost than the skew feed correcting portion illustrated in FIG. 13.

The bearing members 26*a* and 26*b* are held by a frame (not illustrated in the drawings) so that a straight line joining the centers of the circular bosses 29*a* and 29*b*, which serve as a center-of-pivotal-movement supporting portion of the shutter member 25, is perpendicular to the conveying direction, in other words, parallel to the width direction. A straight line joining the abutting portions 25*a* and 25*b* together is set parallel to a straight line joining the centers of pivotal movement at the opposite ends of the shutter member 25 together. Thus, the straight line joining the abutting portions 25*a* and 25*b* of the shutter member 25 is substantially perpendicular to the conveying direction.

Figure 4A:
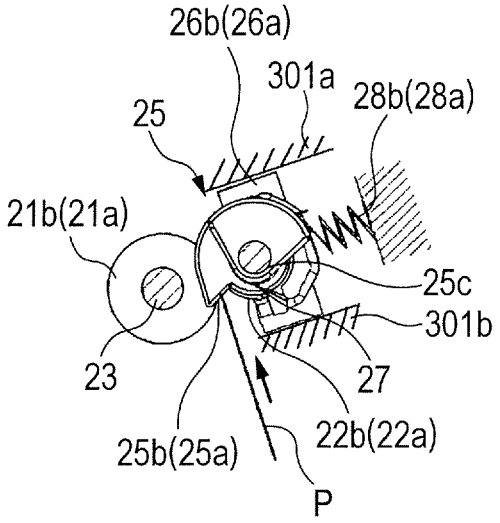
FIGS. 4A, 4B, 4C and 4D are diagrams illustrating a skew feed correcting operation of the skew feed correcting portion.

Now, a skew feed correcting operation of the skew feed correcting portion 2 according to the present exemplary embodiment will be described with reference to FIG. 4A to FIG. 4D. As illustrated in FIG. 4A, the sheet P which is obliquely fed while being conveyed to the skew feed correcting portion 2 by the sheet feeding roller 11 or the duplex conveying roller pair 8 first comes into abutting contact with one of the two abutting portions 25*a* and 25*b* of the shutter member 25. It is thereafter assumed that the sheet P first comes into abutting contact with the abutting portion 25*b* for description.

Figure 4B:
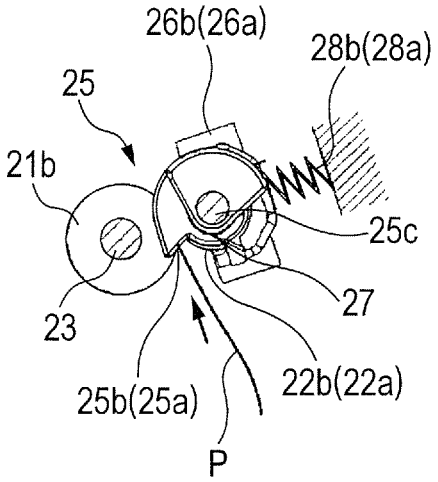

Then, as illustrated in FIG. 4B, a side of the leading end of the sheet P which is in abutting contact with the abutting portion 25*b* is stopped and looped. While this side is being looped, the other side of the sheet P comes into abutting contact with the abutting portion 25*a*. With this series of operations, when the sheet P is looped, the leading end is made by the abutting portions 25*a* and 25*b* of the shutter member 25 to follow a direction perpendicular to the conveying direction. Thus, since the leading end of the sheet P comes into abutting contact with the two abutting portions 25*a* and 25*b*, a force that conveys the sheet P is transmitted to the shutter member 25.

Figure 4C:
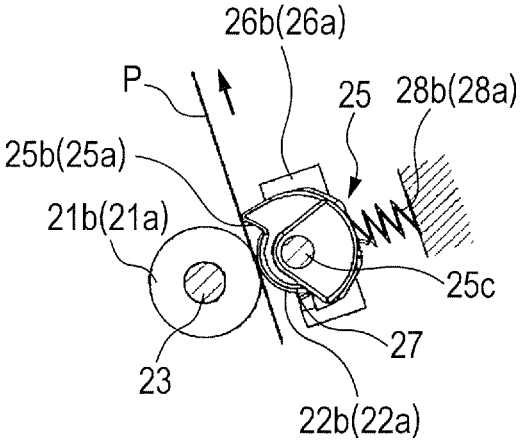

As a result, the bias force exerted by the helical torsion coil spring 27 to bias the shutter member 25 can no longer overcome the conveying force that conveys the sheet P. Thus, as illustrated in FIG. 4C, the shutter member 25 rotates using the bearing members 26*a* and 26*b* as supporting points. As a result, the abutting portions 25*a* and 25*b* of the shutter member 25 retract from the conveying path. The sheet P thus rushes into the nip between the driving roller 21 and the driven roller 22.

During the pivotal movement, in which the shutter member 25 is being pushed by the sheet and moving pivotally with the leading end of the sheet in abutting contact with the abutting portions 25*a* and 25*b*, the leading end of the sheet is nipped by the driving roller 21 and the driven roller 22. That is, while the shutter member 25 is moving pivotally with the leading end of the sheet in abutting contact, the leading end of the sheet is kept in abutting contact with the abutting portions 25*a* and 25*b* of the shutter member 25 until the leading end of the sheet is sandwiched between the driving roller 21 and the driven roller 22. By passing the sheet P through the shutter member 25 while the shutter member 25 is moving pivotally, skew feed of the sheet P is corrected before the sheet P rushes into the nip formed by the driving roller 21 and the driven roller 22. Thereafter, the above-described image forming process is carried out on the sheet P subjected to skew feed correction.

Figure 4D:
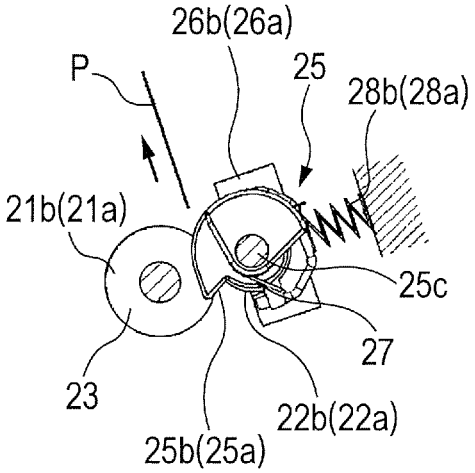

Immediately after the image forming process, a trailing end of the sheet P passes through the shutter member 25 retracted from the conveying path. Then, as illustrated in FIG. 4D, the shutter member 25 returns from the position where the shutter member 25 is retracted from the conveying path to the home position, that is, the original position. Thereafter, the next sheet to be conveyed a predetermined time later is subjected to skew feed correction by an operation similar to the above-described operation.

According to the present exemplary embodiment, the coupling portion 25*c* is shaped like a thin bar substantially centered around the center of pivotal movement of the shutter member 25. The center of gravity of the shutter member 25 is set as close to the center of pivotal movement of the shutter member 25 as possible. The coupling portion 25*c* is formed of resin. Furthermore, the coupling portion 25*c* is located closer to the center of rotation of each of the driven rollers 22*a* and 22*b* than to an outer peripheral surface of each of the driven rollers 22*a* and 22*b* in a radial direction of the driven rollers 22*a* and 22*b*. In general, the moment of inertia increases consistently with the distance between the center of pivotal movement and the center of gravity. Thus, setting the center of gravity of the shutter member 25 as close to the center of pivotal movement of the shutter member 25 as possible enables a reduction in the moment of inertia centered around the center of pivotal movement of the shutter member 25.

Since the shutter member 25 is pivotally movably supported between the two adjacent driven rollers 22*a* and 22*b*, the shutter member 25 is prevented from covering the driven roller 22, enabling a reduction in the size of the shutter member 25. Thus, the moment of inertia centered around the center of pivotal movement of the shutter member 25 can be reduced. This in turn enables a reduction in a time required for the shutter member 25 retracted from the conveying path to return to the home position and in a bound time when the shutter member 25 returns to the home position.

According to the present exemplary embodiment, the two driven rollers 22*a* and 22*b* adjacent to the shutter member 25 are independently provided, and the coupling portion 25*c* of the shutter member 25 is located between the driven rollers 22*a* and 22*b*. Thus, the moment of inertia around the center of pivotal movement of the shutter member 25 can be minimized. This enables a reduction in the time required for the shutter member 25 retracted from the conveying path to return to the home position and in the bound time (the number of bounds) when the shutter member 25 returns to the home position.

Thus the amount of time from the passage of the tailing end of the preceding sheet through the shutter member 25 until the beginning of the skew feed correction of the succeeding sheet can be reduced, and thus the productivity of the laser beam printer 100 can be improved. Moreover, since the time required for the shutter to return and the bound time can be reduced using the simple configuration, the cost and size of the apparatus can be decreased. In the present exemplary embodiment, the insertion holes into which the circular bosses 29*a* and 29*b* of the bearing members 26*a* and 26*b* are inserted are formed in the respective two abutting portions 25*a* and 25*b* of the shutter member 25. However, the insertion holes may be formed in the coupling portion 25*c*. The coupling portion shaped like a thin bar (with a circular cross portion) and extending in the axial direction has been illustrated as the coupling portion 25*c*. However, the coupling portion of the shutter member 25 may be shaped like a plate extending in the axial direction. Alternatively, a member formed to have an L-shaped cross portion and extending in the axial direction may be used as the coupling portion of the shutter member 25.

Figure 5:
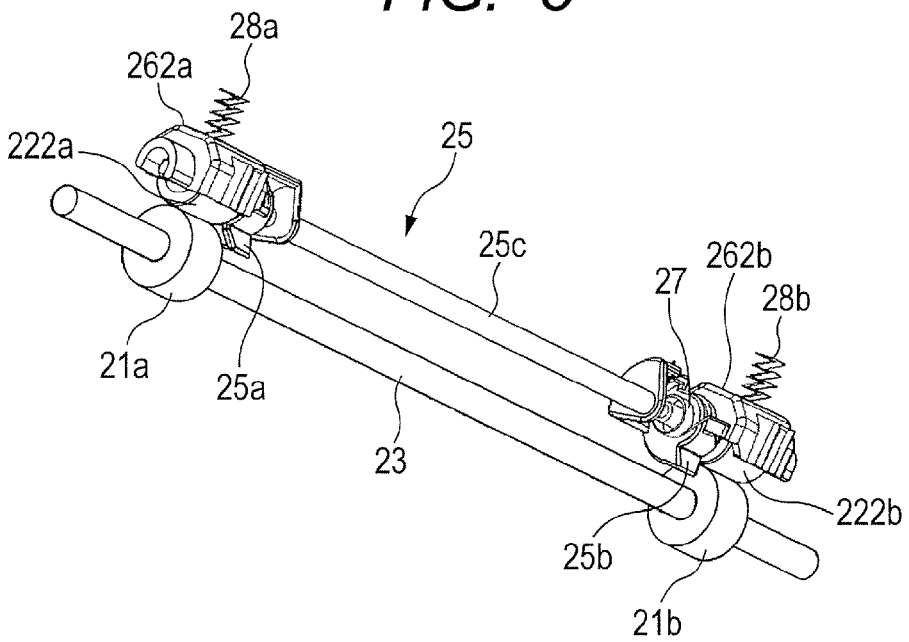
FIG. 5 is a perspective view of a skew feed correcting portion provided in a sheet conveying apparatus according to a second exemplary embodiment of the present invention.
Figure 6:
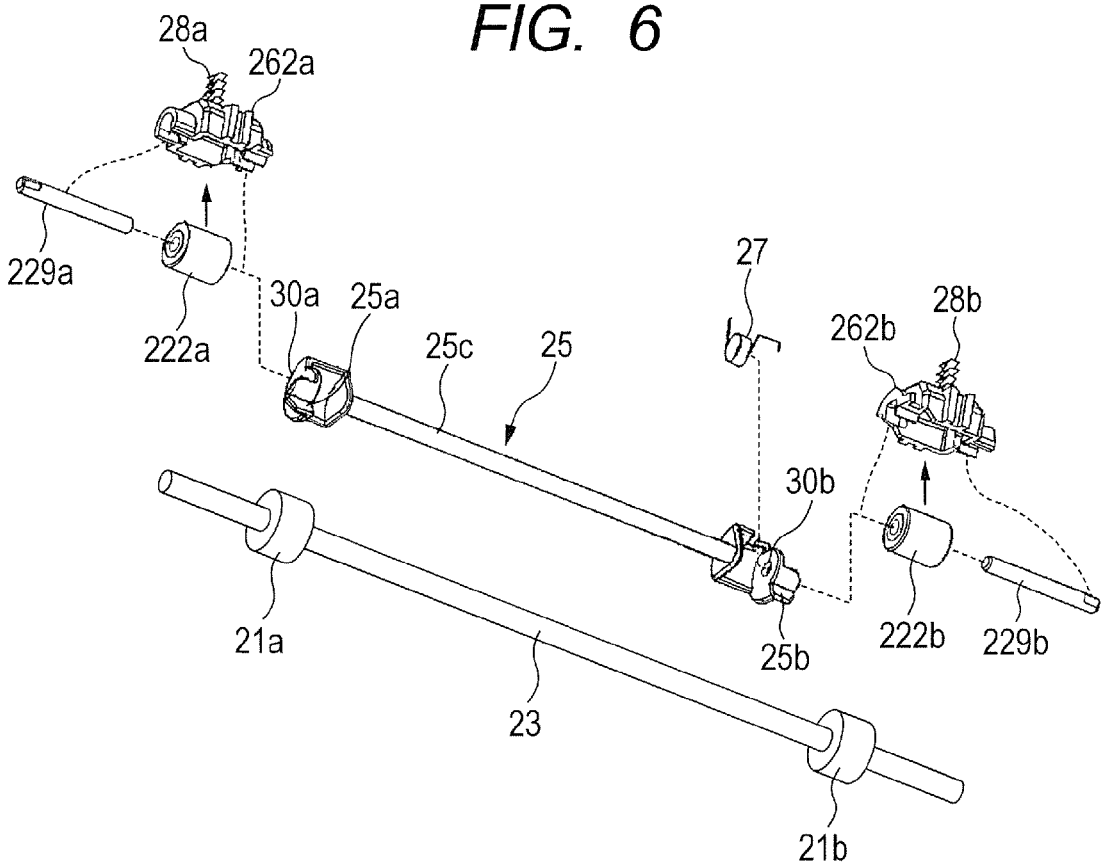
FIG. 6 is an exploded view of the skew feed correcting portion.

Now, a second exemplary embodiment of the present invention will be described. FIG. 5 is a perspective view of a skew feed correcting portion provided in a sheet conveying apparatus according to the present exemplary embodiment. FIG. 6 is an exploded diagram of the skew feed correcting portion. The same reference numerals in FIG. 5 and FIG. 6 as those in FIG. 2 and FIG. 3 described above denote identical or corresponding components.

In FIG. 5 and FIG. 6, a cylindrical driven roller 222 (222*a* and 222*b*) is a rotating portion that pressure contacts against the driving roller 21. The driven roller 222 is rotatably supported by shafts 229*a* and 229*b* that are shaft members respectively penetrating an inner diameter portion. That is, according to the present exemplary embodiment, the driven roller 222 and the shafts 229*a* and 229*b* form a second rotation member.

The opposite ends of each of the shafts 229*a* and 229*b* of the driven roller 222 are pivotally supported by a corresponding one of bearing members 262*a* and 262*b*. According to the present exemplary embodiment, a mounting portion of each of the shafts 229*a* and 229*b* which is mounted in the corresponding one of the bearing members 262*a* and 262*b* is shaped to allow for two way removal. Thus, the shafts 229*a* and 229*b* cannot rotate with respect to the bearing members 262*a* and 262*b*. According to the present exemplary embodiment, the shaft 229*a* and the bearing member 262*a* form a first holder that pivotally supports the driven roller 222. Furthermore, according to the present exemplary embodiment, the shaft 229*b* and the bearing member 262*b* form a second holder that pivotally supports the driven roller 222*b*.

When mounted in the bearing members 262*a* and 262*b*, the shafts 229*a* and 229*b* project from inner side surfaces of the bearing members 262*a* and 262*b*, respectively. The projecting portions of the shafts 229*a* and 229*b* are respectively inserted into the insertion holes 30*a* and 30*b* which are formed in the abutting portions 25*a* and 25*b* of the shutter member 25. Thus, the shutter member 25 is pivotally supported by the bearing members 262*a* and 262*b* coaxially with the driven roller 222. That is, the shutter member 25 has the center of pivotal movement thereof supported by the bearing members 262*a* and 262*b* at the opposite ends of the shutter member 25.

The bearing members 262*a* and 262*b* are held by a frame (not illustrated in the drawings) so that a straight line joining the centers of the shafts 229*a* and 229*b*, which are center-of-pivotal-movement support portions of the shutter member 25, is orthogonal to the conveying direction. A straight line joining the abutting portions 25*a* and 25*b* is set parallel to the straight line joining the centers of pivotal movement at the opposite ends of the shutter member 25. Thus, the straight line joining the abutting portions 25*a* and 25*b* of the shutter member 25 is substantially perpendicular to the conveying direction.

According to the present exemplary embodiment, the center of rotation of the shutter member 25 is supported by the shafts 229*a* and 229*b*, which are rotating shafts of the driven roller 222. Thus, the bearing members 262*a* and 262*b* are not directly involved in the positional relationship between the conveying nip formed by the driven roller 222 and the driving roller 21 and the abutting portions 25*a* and 25*b* of the shutter member 25. This configuration allows the conveying nip and the abutting portions of the shutter member 25 to be more accurately positioned.

Figure 7:
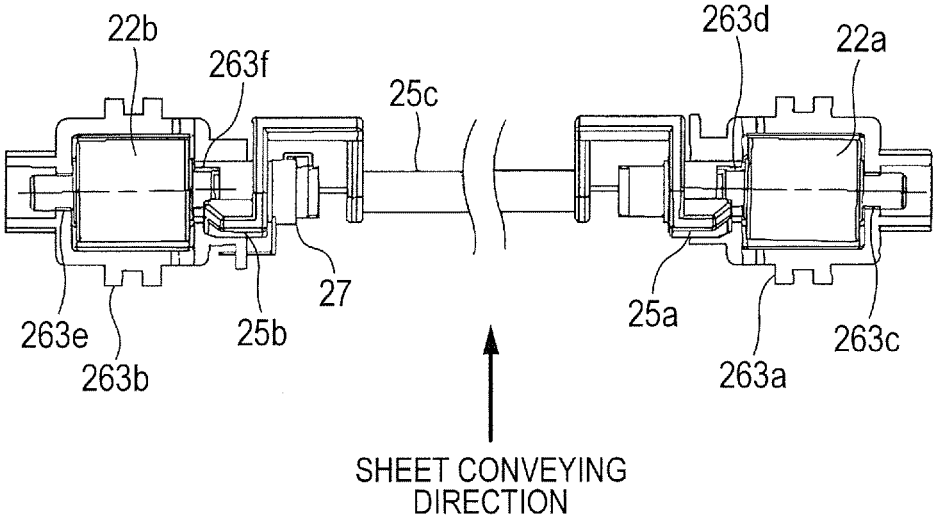
FIG. 7 illustrates a configuration of a skew feed correcting portion provided in a sheet conveying apparatus according to a third exemplary embodiment of the present invention.

Now, a third exemplary embodiment of the present invention will be described. FIG. 7 illustrates a configuration of a skew feed correcting portion provided in a sheet conveying apparatus according to the present exemplary embodiment. The same reference numerals in FIG. 7 as those in FIG. 2 described above denote identical or corresponding components.

In FIG. 7, the bearing members 263*a* and 263*b* include pivotally support portions 263*c* to 263*f* that pivotally support a rotating shaft of the driven roller 22 with a rotation member and the rotating shaft integrated together, respectively. The shutter member 25 has the center of pivotal movement thereof supported by the bearing members 263*a* and 263*b* at the opposite ends thereof, as described above in the first exemplary embodiment. Thus, the moment of inertia around the center of pivotal movement of the shutter member 25 can be minimized.

According to the present exemplary embodiment, the pivotally support portion 263*d* located inside the bearing member 263*a* is disposed so as to be displaced downstream of the outer pivotally support portion 263*c* in the conveying direction. Thus, when mounted in the bearing member 263*a*, the driven roller 22*a* is inclined to the driving roller 21 in the sheet conveying direction. Similarly, the pivotally support portion 263*f* located inside the bearing member 263*b* is disposed so as to be displaced downstream of the outer pivotally support portion 263*e* in the sheet conveying direction. Thus, when mounted in the bearing member 263*b*, the driven roller 22*b* is inclined to the driving roller 21 in the sheet conveying direction.

Figure 8:
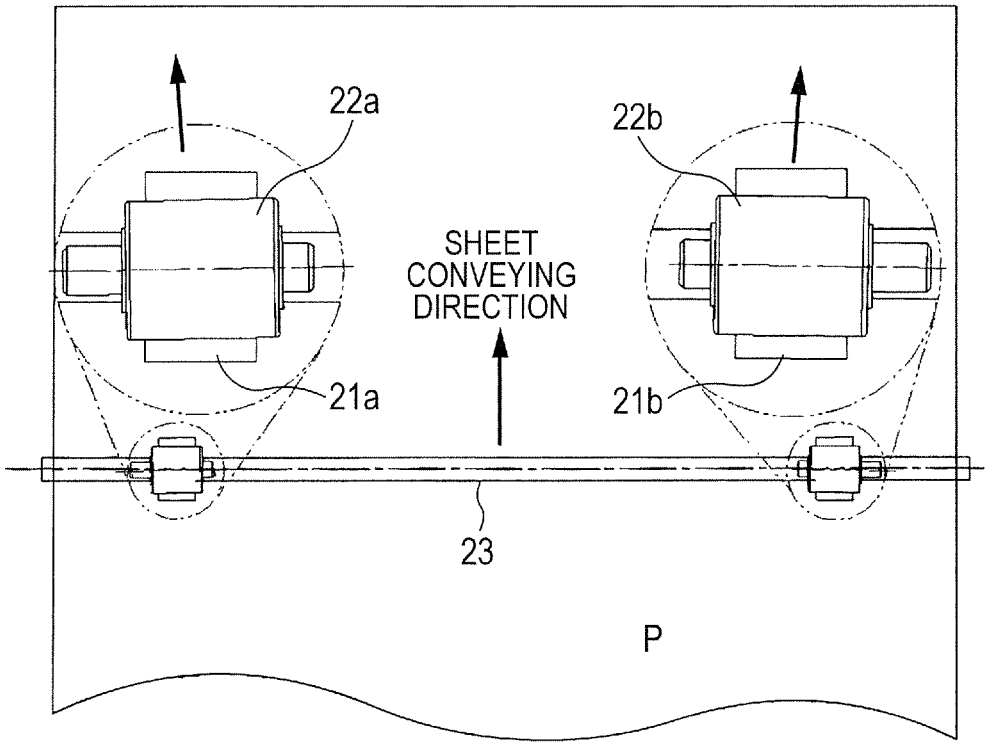
FIG. 8 illustrates the state of the skew feed correcting portion observed when a sheet is conveyed by the skew feed correcting portion.

FIG. 8 illustrates the state of the skew feed correcting portion observed when the sheet is conveyed by the skew feed correcting portion. In FIG. 8, the illustration of the bearing members 263*a* and 263*b*, the shutter member 25, and the helical torsion coil spring 27 is omitted in order to illustrate the inclination of the driven rollers 22*a* and 22*b*. Each of the driven rollers 22*a* and 22*b* is oriented such that the widthwise inner end is inclined downstream of the widthwise outer end in the sheet conveying direction. In this case, during conveyance, the sheet P is stretched outward with respect to the sheet conveying direction.

Stretching the sheet P outward during conveyance allows the sheet P to be stably conveyed without being affected by possible back tension on the upstream side of the skew feed correcting portion 2 or possible conveying resistance or disturbance on the downstream side of the skew feed correcting portion 2. That is, when the shutter member 25 has the center of pivotal movement thereof supported by the bearing members 263*a* and 263*b* at the opposite ends thereof as is the case with the present exemplary embodiment, the driven roller 22 can be arranged so as to incline to the conveying direction of the driving roller 21.

When the driven roller 22 is arranged so as to incline to the conveying direction of the driving roller 21, the sheet P subjected to skew feed correction can be more accurately and stably conveyed to the image forming portion. Consequently, the accuracy of an image printing position can be improved.

Figure 9:
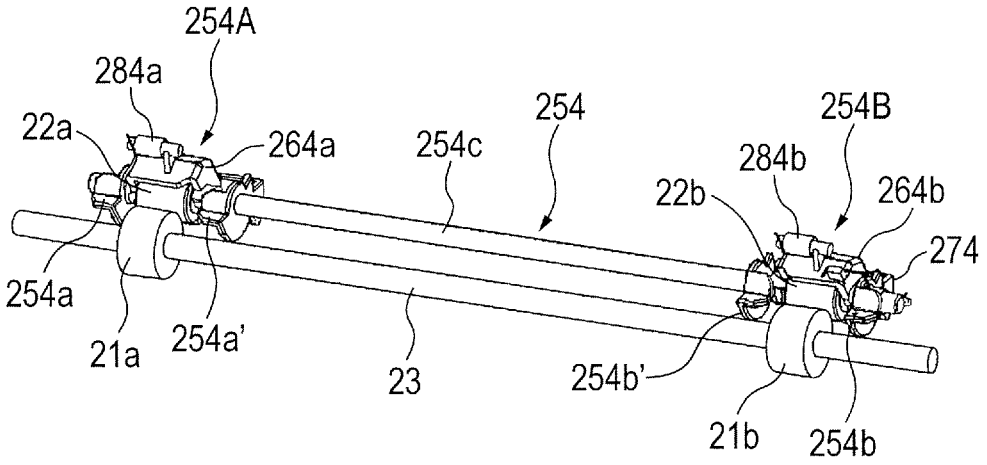
FIG. 9 is a perspective view of a skew feed correcting portion provided in a sheet conveying apparatus according to a fourth exemplary embodiment of the present invention.
Figure 10:
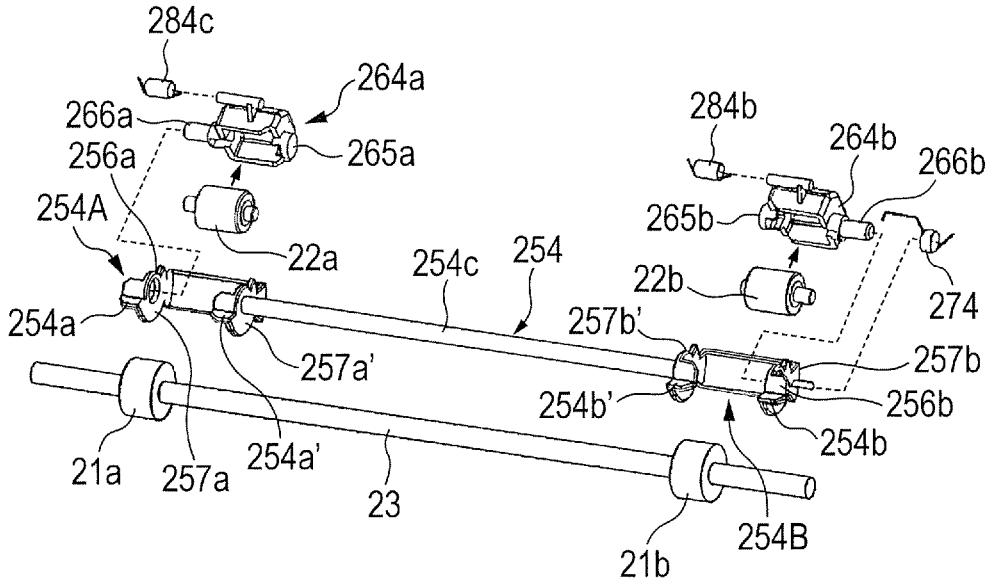
FIG. 10 is an exploded view of the skew feed correcting portion.

Now, a fourth exemplary embodiment of the present invention will be described. FIG. 9 is a perspective view of a skew feed correcting portion provided in a sheet conveying apparatus according to the present exemplary embodiment. FIG. 10 is an exploded diagram of the skew feed correcting portion. The same reference numerals in FIG. 9 and FIG. 10 as those in FIG. 2 and FIG. 3 described above denote identical or corresponding components.

In FIG. 9 and FIG. 10, a shutter member 254 includes abutting members 254A and 254B at the opposite ends thereof in the width direction. The abutting member 254A includes two ribs 257*a* and 257*a*' arranged at a predetermined distance from each other in the width direction. The abutting member 254B includes two ribs 257*b* and 257*b*' arranged at a predetermined distance from each other in the width direction. Leading ends of the ribs 257*a*, 257*a*', 257*b*, and 257*b*' form abutting portions 254*a*, 254*a*', 254*b* and 254*b*'.

A coupling portion 254*c* of the shutter member 254 is fixed so as to be inserted through the inner ribs 257*a*' and 257*b*' of the abutting members 254A and 254B and so as to project inward. The four abutting portions 254*a*, 254*a*', 254*b* and 254*b*' provided in the two abutting members 254A and 254B in the width direction are coupled together by the coupling portion 254*c*. The outer ribs 257*a* and 257*b* of the abutting members 254A and 254B include through-holes 256*a* and 256*b*, respectively, formed therein coaxially with the coupling portion 254*c*.

In FIG. 9 and FIG. 10, the driven roller 22 (22*a* and 22*b*) with a rotation member and a rotating shaft integrated together is rotatably supported by bearing members 264*a* and 264*b*. The bearing members 264*a* and 264*b* include circular bosses 266*a* and 266*b* which are provided on outer side surfaces thereof in a projecting manner and which are inserted through the through-holes 256*a* and 256*b* formed in the outer ribs 257*a* and 257*b* of the abutting members 254A and 254B of the shutter member 254. Through-holes 265*a* and 265*b* are formed in inner side surfaces of the bearing members 264*a* and 264*b*, respectively, so that the opposite ends of the coupling portion 254*c* projecting from the inner ribs 257*a*' and 257*b*' of the abutting members 254A and 254B of the shutter member 254 are inserted through the through-holes 265*a* and 265*b*, respectively.

The circular bosses 266*a* and 266*b* of the bearing members 264*a* and 264*b* are inserted into the through-holes 265*a* and 265*b* in the abutting members 254A and 254B. Furthermore, the opposite ends of the coupling portion 254*c* are inserted through the through-holes 265*a* and 265*b* in the abutting members 254A and 254B. Thus, the bearing members 264*a* and 264*b* support the center of pivotal movement of the shutter member 254 outside the driven roller 22.

The coupling portion 254*c* is shaped like a bar the center of which is substantially the same as the center of pivotal movement of the shutter member 254. The center of gravity of the shutter member 254 is set as close to the center of pivotal movement of the shutter member 254 as possible. Thus, the moment of inertia centered around the center of pivotal movement of the shutter member 254 is minimized. The shutter member 254 with the center of pivotal movement thereof supported by the bearing members 264*a* and 264*b* is biased in the direction opposite to the sheet conveying direction by a helical torsion coil spring 274 mounted in the bearing member 264*b*. Hence, when the shutter member 254 is at the home position, the abutting portions 254*a*, 254*a*', 254*b* and 254*b*' project upstream of the conveying nip formed by the driving roller 21 and the driven roller 22 in the conveying direction.

The bearing members 264*a* and 264*b* are held by a frame (not illustrated in the drawings) so that a straight line joining the centers of the through-holes 265*a* and 265*b*, which are center-of-pivotal-movement support portions of the shutter member 254, and circular bosses 266*a* and 266*b* is orthogonal to the conveying direction. A straight line joining the abutting portions 254*a*, 254*a*', 254*b* and 254*b*' together is set parallel to a straight line joining the centers of pivotal movement at the opposite ends of the shutter member 254 together. Thus, the straight line joining the abutting portions 254*a*, 254*a*', 254*b* and 254*b*' of the shutter member 254 together is substantially perpendicular to the conveying direction.

The bearing members 264*a* and 264*b* cause the driven roller 22 to pressure contact against the driving roller 21 by receiving a pressure force from pressurizing helical torsion coil springs 284*a* and 284*b*. The helical torsion coil springs 284*a* and 284*b* are arranged so as to avoid a pivotal movement trajectory of the shutter member 254 and supported at a fixed end thereof by a frame (not illustrated in the drawings).

According to the present exemplary embodiment, the abutting portions 254*a*, 254*a*', 254*b* and 254*b*' are provided both inside and outside of the driven roller 22. Providing the abutting portions 254*a*, 254*a*', 254*b* and 254*b*' on the opposite sides of the driven roller 22 increases the area of a contact of the leading end of the sheet during skew feed correction. This reduces the force applied to the leading end of the sheet, and thus the likelihood of fold-back or curl-back of the leading end of the sheet is reduced. Therefore, skew feed correction can be achieved without damaging the sheet.

Figure 11:
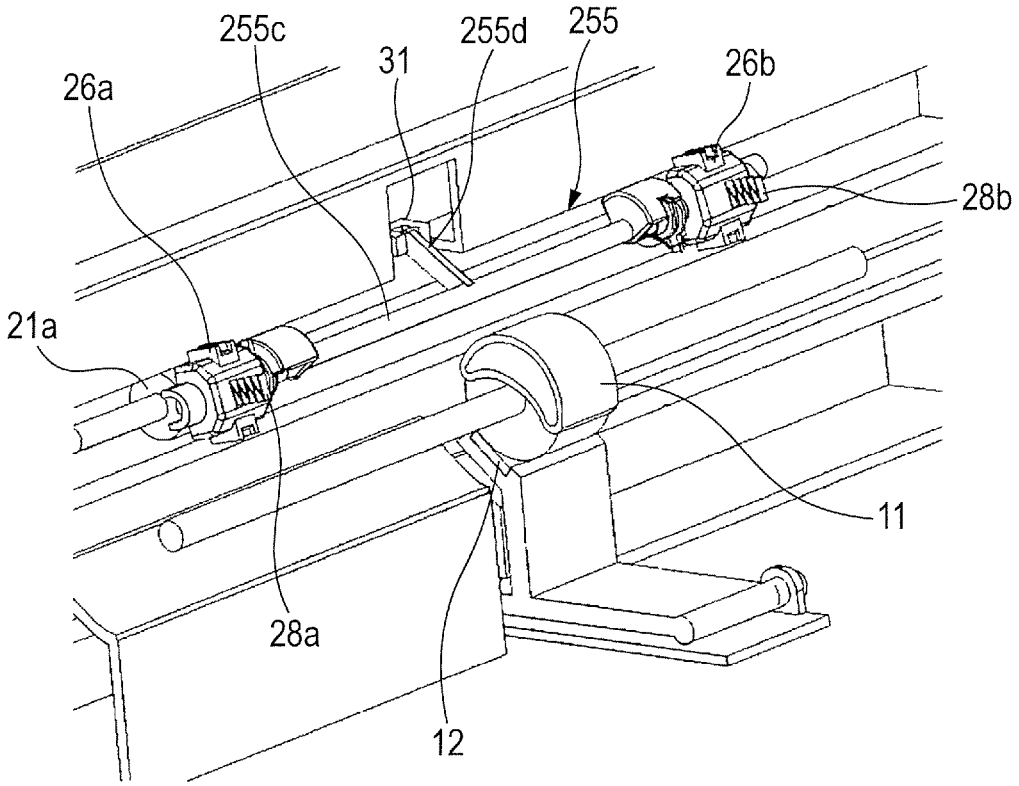
FIG. 11 is a perspective view of an essential part of a sheet conveying apparatus according to a fifth exemplary embodiment of the present invention.

Now, a fifth exemplary embodiment of the present invention will be described. FIG. 11 is a perspective view of an essential part of a sheet conveying apparatus according to the present exemplary embodiment. The same reference numerals in FIG. 11 as those in FIG. 1 and FIG. 2 described above denote identical or corresponding components.

In the present exemplary embodiment, a detecting portion that detects the leading end of the sheet P is provided in the skew feed correcting portion 2. In FIG. 11, a coupling portion 255*c* of a shutter member 255 is integrated with a sheet detecting flag 255*d* that is a sensor flag. Furthermore, in FIG. 11, a photo interrupter 31 is a detecting portion that detects passage of the sheet. The photo interrupter 31 is set such that when the shutter member 255 is at the home position, the sheet detecting flag 255*d* blocks the optical axis of the photo interrupter 31.

The (coupling portion 255*c* of the) shutter member 255 is pivotally supported by the bearing members 26*a* and 26*b* that are made slidable, by the frame (not illustrated in the drawings), in a direction parallel to the direction of pressurization by the pressurizing springs 28*a* and 28*b*. When the shutter member 255 is pressed and pivotally moved by the sheet, the sheet detecting flag 255*d* moves from a posture in which the sheet detecting flag 255*d* blocks the optical axis of the photo interrupter 31 to a posture in which the sheet detecting flag 255*d* avoids blocking the optical axis of the photo interrupter 31. This allows the leading end of the sheet to be detected.

Figure 12A:
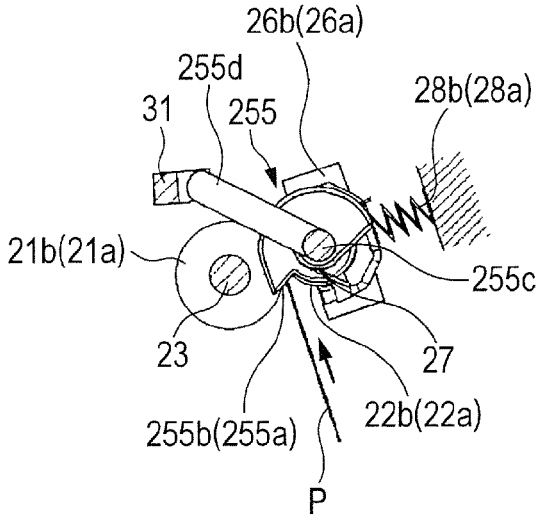
FIGS. 12A, 12B, 12C and 12D illustrate a skew feed correcting operation and a sheet detecting operation of the skew feed correcting portion.

Now, a skew feed correcting operation and a sheet detecting operation of the skew feed correcting portion according to the present exemplary embodiment will be described with reference to FIG. 12A to FIG. 12D. As shown in FIG. 12A, the sheet P which is obliquely fed while being conveyed to the skew feed correcting portion 2 by one of the sheet feeding roller 11 and the duplex conveying roller pair 8 first comes into abutting contact with one of the two abutting portions 255*a* and 255*b* of the shutter member 25. It will be subsequently assumed that the sheet P first comes into contact with the abutting portion 255*b*.

Figure 12B:
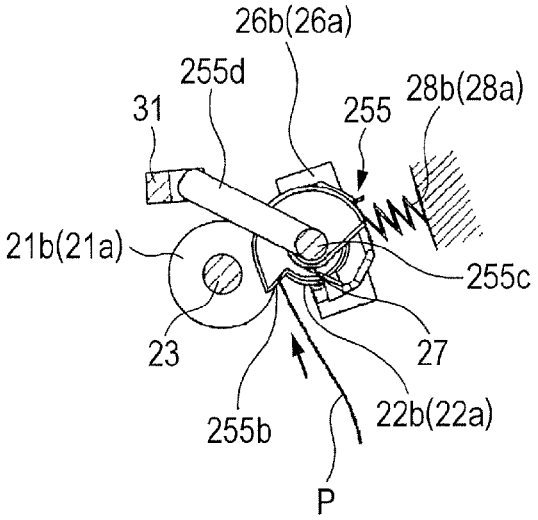

Then, as illustrated in FIG. 12B, a side of the leading end of the sheet P which is in abutting contact with the abutting portion 255*b* is stopped and looped. While this side is being looped, the other side of the sheet P comes into abutting contact with the abutting portion 255*a*. With this series of operations, when looped, the leading end of the sheet P is made by the abutting portions 255*a* and 255*b* of the shutter member 255 to follow a direction perpendicular to the sheet conveying direction. At this time, the sheet detecting flag 255*d* blocks the optical axis of the photo interrupter 31.

Figure 12C:
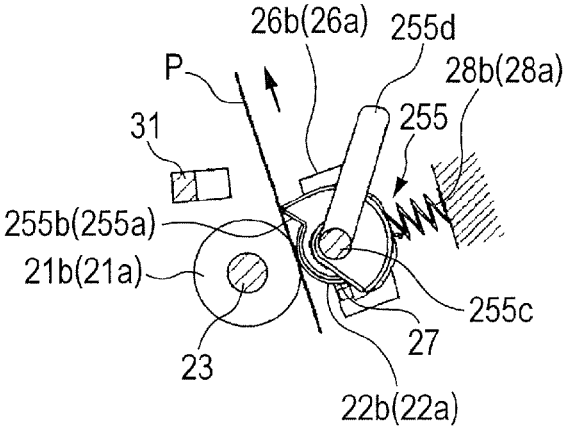

Since the leading end of the sheet P has come into contact with the two abutting portions 255*a* and 255*b*, a conveying force that conveys the sheet P is transmitted to the shutter member 255. As a result, the bias force for the shutter member 255 cannot overcome the conveying force that conveys the sheet P. As shown in FIG. 12C, the shutter member 255 rotates to retract the abutting portions 255*a* and 255*b* of the shutter member 255 from the conveying path. The sheet P rushes into the nip between the driving roller 21 and the driven roller 22. Passing the sheet P through the shutter member 255 being pivotally moved allows skew feed correction of the sheet P to be completed before the sheet P rushes into the nip between the driving roller 21 and the driven roller 22.

At this time, the sheet detecting flag 255*d* moves pivotally together with the shutter member 255 and assumes the posture in which the sheet detecting flag 255*d* avoids blocking the optical axis of the photo interrupter 31. This operation subjects the sheet P to skew feed correction, and it is detected that the leading end of the sheet P rushes into the nip between the driving roller 21 and the driven roller 22. Thereafter, the above-described image forming process is carried out on the sheet P subjected to the skew feed correction.

Figure 12D:
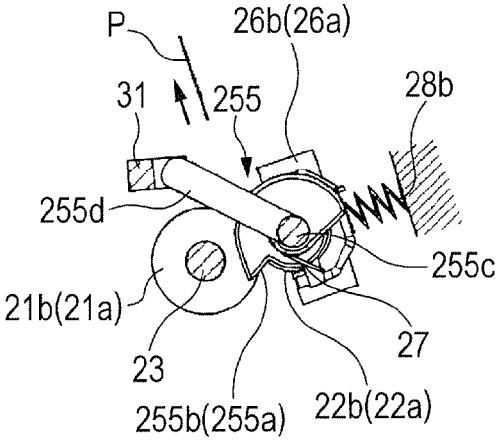

Immediately after the image forming process, when the trailing end of the sheet P passes through the shutter member 255 which is retracted from the conveying path, as illustrated in FIG. 12D, the shutter member 255 returns from the position where the shutter member 255 is retracted from the conveying path to the home position, that is, the original position. Thereafter, the next sheet to be conveyed a predetermined time later is subjected to skew feed correction by an operation similar to the above-described operation.

According to the present exemplary embodiment, as is the case with the above-described first exemplary embodiment, the shutter member 255 is configured to have the center of pivotal movement thereof supported by the bearing members 26*a* and 26*b* at the opposite ends thereof. Thus, the shutter member 255 can return from the position where the shutter member 255 is retracted from the conveying path to the home position, in a short time. In conjunction with this, the sheet detecting flag 255*d* can also return to the position where the sheet detecting flag 255*d* blocks the optical axis of the photo interrupter 31 in a short time.

As described above, according to the present exemplary embodiment, the sheet detecting flag 255*d* is provided in the shutter member 255 with the center of pivotal movement thereof located at the bearing member 26 holding the driven roller 22. Thus, the accuracy of position of the sheet detecting flag 255*d* is unlikely to be affected by the tolerances of the parts, improving the accuracy of sheet detection. The present exemplary embodiment also eliminates the need for a separate sheet detecting flag, enabling a reduction in the size and cost of the apparatus.

In the above description, the coupling portion 25*c* of the shutter member 25 is shaped like a bar in order to minimize the moment of inertia. However, the coupling portion 25*c* may be shaped like a flat beam or a semicylinder as long as the shape enables a reduction in the moment of inertia. That is, according to the present invention, the coupling portion 25*c* may have any cross-sectional shape to use the cross-sectional area of the driven roller, which shape is conventionally unavailable.

In the above description, the skew feed correcting portion is disposed downstream of the sheet feeding roller 11 as shown in FIG. 1. However, the skew feed correcting portion is applicable to any portion of the apparatus as long as the portion provides a function to convey the sheet. For example, the skew feed correcting portion is applicable to various apparatuses such as a transfer portion, a heat fixing portion, and a sheet discharging portion which have a function to convey the sheet, for example, the duplex conveying path in which the duplex conveying roller pair 8 is positioned.

For example, in the above-described first exemplary embodiment, the configuration has been described in which the bearing member 26 holds the driven roller 22 and a pressure force is applied to the bearing member 26 by the pressuring spring 28. However, the present invention is not limited to this configuration. For example, the following configuration is possible. The driven roller includes a cylindrical rotation member and a compression spring shaped like a shaft to generate a pressure force between the fixed bearing member 26 and the driven roller 22.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a Divisional application of U.S. patent application Ser. No. 13/558,617, filed on Jul. 26, 2012, which claims the benefit of Japanese Patent Application No. 2011-180630, filed Aug. 22, 2011, which are hereby incorporated by reference herein in their entireties.

What is claimed is:

1. A sheet skew feed correcting apparatus comprising:

a driving rotation member that is driven to rotate;

a first driven rotation roller that is pressure contacted against the driving rotation member so that the first driven rotation roller and the driving rotation member nip and convey a sheet;

a first holder that rotatably holds the first driven rotation roller;

a second driven rotation roller which is pressure contacted against the driving rotation member so that the second driven rotation roller and the driving rotation member nip and convey the sheet, wherein the first driven rotation roller and the second driven rotation roller are arranged along a width direction of the sheet orthogonal to a conveying direction;

a second holder that rotatably holds the second driven rotation roller; and a shutter portion that pivotally moves to a position through which the sheet is allowed to pass after a leading end of the conveyed sheet comes into contact with the shutter portion for a skew feed correction of the sheet the shutter portion moving pivotally with one end portion thereof supported by the first holder and another end portion thereof supported by the second holder in the width direction of the sheet, wherein the shutter portion has:

a plurality of abutting portions with which the leading end of the sheet comes into contact, the abutting portions arranged at intervals in the width direction, and a coupling portion extending in the width direction to couple the plurality of abutting portions together between the first driven rotation roller and the second driven rotation roller in the width direction, the coupling portion arranged closer to a center of rotation of each of the first and second driven rotation rollers than to an outer peripheral surface of each of the first and second driven rotation rollers in a radial direction of the first driven and second driven rotation rollers, and wherein the plurality of abutting portions includes a first abutting portion and a second abutting portion, and the coupling portion is independent from a shaft of the first driven rotation roller and a shaft of the second driven rotation roller, wherein the first driven rotation roller is pivotally supported by the first holder and the second driven rotation roller is pivotally supported by the second holder, so that inner ends of the first and second driven rotation rollers in the width direction are, with respect to the conveying direction, located downstream of outer ends of the first and second driven rotation rollers in the width direction.

2. The sheet skew feed correcting apparatus according to claim 1, wherein the first holder has a first boss configured to rotatably support the one end portion of the shutter portion, the second holder has a second boss configured to rotatably support the another end portion of the shutter portion, and the coupling portion is coaxially arranged with the first boss and the second boss.

3. The sheet skew feed correcting apparatus according to claim 2, wherein the first abutting portion has a first insertion hole into which the first boss is to be inserted, and the second abutting portion has a second insertion hole into which the second boss is to be inserted.

4. The sheet skew feed correcting apparatus according to claim 1, wherein the coupling portion is formed of resin.

5. The sheet skew feed correcting apparatus according to claim 1, wherein the first abutting portion and the second abutting portion are arranged between the first driven rotation roller and the second driven rotation roller.

6. The sheet skew feed correcting apparatus according to claim 1, wherein the first holder is movably held by a frame, and a first spring for pressure contacting the first driven rotation roller against the driving rotation member is provided between the first holder and the frame, and the second holder is movably held by the frame, and a second spring for pressure contacting the second driven rotation roller against the driving rotation member is provided between the second holder and the frame.

7. The sheet skew feed correcting apparatus according to claim 1, wherein, while the shutter portion is moving pivotally with the leading end of the conveyed sheet as the leading end of the conveyed sheet contacts with the first abutting portion and the second abutting portion, the leading end of the conveyed sheet is nipped by the first driven rotation roller and the driving rotation member and by the second driven rotation roller and the driving rotation member.

8. The sheet skew feed correcting apparatus according to claim 1, further comprising:

a flag portion provided on the coupling portion and configured to integrally rotate with the shutter portion; and a detecting portion configured to detect the flag portion.

9. An image forming apparatus comprising:

the sheet skew feed correcting apparatus according to claim 1 for a skew feed correction of a sheet; and an image forming portion configured to form an image on a sheet to be subjected to the skew feed correction by the sheet skew feed correcting apparatus.

10. A sheet skew feed correcting apparatus comprising:

a driving rotation member that is driven to rotate;

a first driven rotation roller that is pressure contacted against the driving rotation member so that the first driven rotation roller and the driving rotation member nip and convey a sheet;

a first holder that rotatably holds the first driven rotation roller;

a second driven rotation roller which is pressure contacted against the driving rotation member so that the second driven rotation roller and the driving rotation member nip and convey the sheet, wherein the first driven rotation roller and the second driven rotation roller are arranged along a width direction of the sheet orthogonal to a conveying direction;

a second holder that rotatably holds the second driven rotation roller; and a shutter portion that pivotally moves to a position through which the sheet is allowed to pass after a leading end of the conveyed sheet comes into contact with the shutter portion for a skew feed correction of the sheet and the shutter portion moving pivotally with one end portion thereof supported by a first shaft of the first holder and another end portion thereof supported by a second shaft of the second holder in the width direction of the sheet, wherein the shutter portion has:

a plurality of abutting portions with which the leading end of the sheet comes into contact, the abutting portions arranged at intervals in the width direction; and a coupling portion extending in the width direction to couple the plurality of abutting portions together between the first driven rotation roller and the second driven rotation roller in the width direction, the coupling portion arranged closer to a center of rotation of each of the first and second driven rotation rollers than to an outer peripheral surface of each of the first and second driven rotation rollers in a radial direction of the first and second driven rotation rollers, and wherein the plurality of abutting portions includes a first abutting portion and a second abutting portion, and the coupling portion is independent from the first shaft and the second shaft, wherein the first driven rotation roller is pivotally supported by the first holder and the second driven rotation roller is pivotally supported by the second holder, so that inner ends of the first and second driven rotation rollers in the width direction are, with respect to the conveying direction, located downstream of outer ends of the first and second driven rotation rollers in the width direction.

11. The sheet skew feed correcting apparatus according to claim 10, wherein the coupling portion is coaxially arranged with the first shaft and the second shafts.

12. The sheet skew feed correcting apparatus according to claim 11, wherein the first abutting portion has a first insertion hole into which the first shaft is to be inserted, and the second abutting portion has a second insertion hole into which the second shaft is to be inserted.

* * * * *